United States Patent [19]

Siemers et al.

[11] Patent Number: 4,577,431

[45] Date of Patent: Mar. 25, 1986

[54] WEAR RESISTANT GUN BARREL AND METHOD OF FORMING

[75] Inventors: Paul A. Siemers, Clifton Park; Robert W. Kopp, Ballston Lake; Melvin R. Jackson, Schenectady, all of N.Y.; Steven R. Duke, Williston, Vt.; David P. Perrin, Charlotte, Vt.; Ying H. Liu, South Burlington, Vt.

[73] Assignee: General Electric Company, Schenectady, N.Y.

[21] Appl. No.: 606,110

[22] Filed: May 2, 1984

[51] Int. Cl.[4] ..... F41C 21/02; B05D 1/08

[52] U.S. Cl. ..... 42/76 A; 427/34

[58] Field of Search ..... 42/76 A, 78; 428/547; 219/76.62, 121 PL; 427/34, 423

[56] References Cited

U.S. PATENT DOCUMENTS

| | | | |
|---|---|---|---|
| 2,104,319 | 1/1938 | Dicke | 42/76 A |
| 2,395,044 | 2/1946 | Gorton | 42/76 A |
| 2,799,959 | 7/1957 | Osborn | 42/76 A |
| 2,850,828 | 9/1958 | Sullivan | 42/76 A |
| 3,112,539 | 12/1963 | Barker | 427/34 |
| 3,156,040 | 11/1964 | Drexhage | 427/423 |
| 3,427,185 | 2/1969 | Cheatham et al. | 427/34 |
| 3,427,698 | 2/1969 | Guzewicz | 427/34 |
| 3,717,914 | 2/1973 | Baird et al. | 427/34 |
| 3,740,522 | 6/1973 | Muehlberger | 219/121 P |
| 3,823,302 | 7/1974 | Muehlberger | 219/121 P |
| 3,839,618 | 10/1974 | Muehlberger | 219/121 P |
| 3,914,573 | 10/1975 | Muehlberger | 219/76 |
| 4,101,712 | 7/1978 | Bomford et al. | 428/547 |
| 4,328,257 | 5/1982 | Muehlberger et al. | 427/34 |
| 4,371,563 | 2/1983 | Muehlberger | 427/34 |
| 4,409,881 | 10/1983 | van der Wielen | 89/16 |

FOREIGN PATENT DOCUMENTS

| | | | |
|---|---|---|---|
| 26511 | 4/1981 | European Pat. Off. | 42/76 A |

OTHER PUBLICATIONS

*Materials Progress,* vol. 83, No. 3, Mar. 1963, L. W. Davis, "How to Deposit Metallic and Nonmetallic Coatings with the Plasma Arc Torch", pp. 105–108.

*Materials in Design Engineering,* Apr. 1959, W. H. Herz, "Cermets/Two New Forms", pp. 98–99.

*Ordinance,* Mar.–Apr. 1961, V. A. Lamb and J. P. Young, "Plating Gun Bores", pp. 725–727.

*Popular Science,* vol. 3, No. 2, Feb. 1959, "Torch Creates Superheat to Melt Hardest Metal", p. 88.

*Primary Examiner*—Charles T. Jordan

*Assistant Examiner*—Ted L. Parr

*Attorney, Agent, or Firm*—Paul E. Rochford; James C. Davis, Jr.; James Magee, Jr.

[57] ABSTRACT

A gun barrel is produced by vacuum plasma spray depositing an inner layer of a refractory metal as a gun barrel liner on a mandrel, followed by deposit of successive layers of dense gun barrel jacket material to build up a structure from the inside out. The outermost layer can include attachment means for fixing the barrel into a gun mechanism.

7 Claims, 6 Drawing Figures

WEAR RESISTANT GUN BARREL AND METHOD OF FORMING

BACKGROUND OF THE INVENTION

The wear which occurs on the internal surface of a gun barrel as a projectile passes through and from the barrel is well known. Such wear and erosion of the surface of the barrel is due in part to the abrasion of the surface of the projectile against the internal wear surface of the gun barrel. In addition, the propellant and propellant gases may also cause abrasion, wear, chemical erosion and occasionally melting. Erosion by melting may be aggravated by the so called "blow by" phenomenon in which extremely high velocity gas passes between portions of the projectile and the wall of the barrel as the projectile is accelerated along the length of the barrel and projected from the muzzle.

While some of these problems can be overcome by the use of exotic metal alloys the cost of construction of gun barrels of such alloys makes such construction too costly. Almost all production gun barrels are made from a low alloy wrought steel having less than 8% alloying elements.

Also attempts have been made to improve the wear resistance and projected useful life of gun barrels by plating with chromium. Other barrels have a short cobalt-based liner at the breech end to reduce erosion of barrel metal. The liner is not metallurgically bonded to the barrel steel.

Where propellants having higher flame temperatures are employed or where very high energy or high velocity projectiles are fired in rapid succession with long bursts from the gun barrels, the current gun barrels do not have acceptable life due to excessive wear at the internal surfaces and due to related reasons.

The mode of failure of structures designed for specific end uses such as gun barrels can be determined by basic mechanisms. One such mechanism is the rate at which heat can be transferred from a surface which receives the heat through the structure to a surface which can dissipate the heat. For example, in a gun barrel the heat is received by the barrel at the barrel interior due to the burning and heat of burning of the propellant material. In addition, frictional force of the projectile moving along and against the surface of the interior of the barrel can generate heat at the immediate surface contacted by the projectile. Where the amount of heat which can be removed from the barrel through normal conduction mechanism is limited, this places a limit also on the application which can be made of the gun. If temperatures become excessive, the gun barrel may fail either locally at the inner surface of the gun barrel by localized melting or metal deformation at high temperature or the physical properties of the overall structure of the barrel may deteriorate resulting in a rupture.

Another mode of failure is the simple mechanical failure to contain the mechanical forces which are applied on the gun barrel. For example, as a propellant is ignited and burns it generates not only heat but also very high pressure and this pressure must be mechanically contained by the barrel. Also, where the projectile leaves its cartridge and starts down the barrel the rifling on the barrel mechanically applies a torsional force to the projectile to give it spin necessary to aid it in its accurate flight to a destination or target. Where the mechanical force needed to initiate rotation of the projectile is excessive, mechanical failure of the barrel can occur at the location adjacent to the chamber where the barrel rifling starts.

Regarding the heat generated at the bore of a gun barrel this heat can build up very rapidly in spite of the fact that the heat can be transferred through the wall of the barrel to the barrel exterior because of the higher rate at which heat can be produced at the bore compared to the rate at which the produced heat can be carried by heat conduction through the thickness of the barrel wall. For a barrel wall of lower conductivity, when long bursts of firing occur, or when the heat produced by the gases are relatively high, this heat production is concentrated at the bore surface and cannot be conducted from the bore rapidly enough because of the limitations in the conductivity of heat through the material of the barrel wall.

There is a heat sink effect in the thickness of the barrel but this heat sink is available only until the temperature of the barrel itself is raised by production of heat within the bore in excess of the quantity of heat which can be conducted through the wall thickness based on the characteristics of the material of the wall itself.

In fact the combined barrel and propellant must be treated as a system because all the elements of the gun must be kept in balance. Any one element which is out of balance with the others can cause failure. For example, if the propellant generates excessive pressure or temperature or is used in excessive amount, this alone could disrupt the balance between the several components of the system and lead to excessive heat and thermal degradation of the barrel or bore surface.

It is recognized in the industry that if guns are designed to fire projectiles at significantly higher rates and velocities and at higher energies, higher performance gun barrels will be needed.

BRIEF SUMMARY OF THE INVENTION

One object of the present invention is to provide an improved gun barrel capable of withstanding higher temperature and related gun operating conditions.

Another object is to provide a gun barrel capable of withstanding higher rates of fire, both intermittent and sustained.

Another object is to provide a gun barrel suitable for use with higher energy propellants.

Another object is to provide a barrel capable of longer term sustained firing operation.

Another object is to provide a gun barrel capable of longer term efficient and effective service.

Other objects will be in part apparent and in part pointed out in the description which follows.

Pursuant to one of the broader aspects of the present invention its objects may be achieved by forming a gun barrel by plasma spray deposition onto a preformed mandrel to have a refractory inner liner and a gun barrel outer jacket formed over the inner liner with an intimate bond therebetween.

DESCRIPTION OF THE INVENTION

The present invention relates to low pressure vacuum plasma spray formation of gun barrels, the gun barrels formed and related articles.

A low pressure plasma deposition process results in rapid solidification plasma deposition of the deposited material to form a layer. Such deposition has typically resulted, at its center, in a layer density which is greater than 97% of the theoretical density of the deposited material. Further, the level of contamination in the deposited material is quite low.

By the prior art it is known that plasma deposition of layers of material in an air atmosphere or in an inert gas atmosphere at atmospheric pressure does result in highly contaminated layers which typically display low density of the deposited material. Such highly contaminated low density deposits are virtually useless for applications involving gun barrels or similar applications.

The arc plasma spray process has been used during the past 25 years to apply coatings to a variety of substrates for applications such as wear resistance and corrosion resistance. However, conventional plasma spray processing usually is done in air. Coatings so applied are characterized by porosity ranging typically in the 5% to 25% range, and high oxide content. Such plasma spray process is simply unsuitable for use in practice of the present invention.

In the practice of the present invention, what is used is a recently developed low pressure plasma deposition process. Using this process, particles are sprayed in an argon or other inert gas atmosphere at a low pressure of 30 to 60 torr. Using this process, high density layers having densities of over 97% at and near the aim point, and which are nearly oxide free are deposited.

In this process a commercially available plasma gun was used with the following parameters:

Gun power—1300 amps at 50 volts
Deposition pressure—60 torr
Powder-feeders rate—15 kg/hr.
Gun to mandrel distance—31 cm.
Spray to mandrel angle—90°

Surprisingly it has been found that by the use of the low pressure plasma deposition process significant improvements can be made in gun barrels, in their construction, in their performance and in the cost at which such more effective and efficient barrels can be produced. These improvements are achieved in part due to the use of rapid solidification plasma deposition to form composite barrels of multiple layers and the attainment of a high density in and between the layers of deposited material of the order of 97% of theoretical density. It is also due in part to the attainment of such density at low contamination levels. The deposition of such high density layers makes possible the use of the resultant composite barrels to fire very high energy ammunition with very high velocity projectiles. The use of such composite multilayer barrels also makes possible the firing of long bursts of ammunition at high rates of fire.

Figure 1:
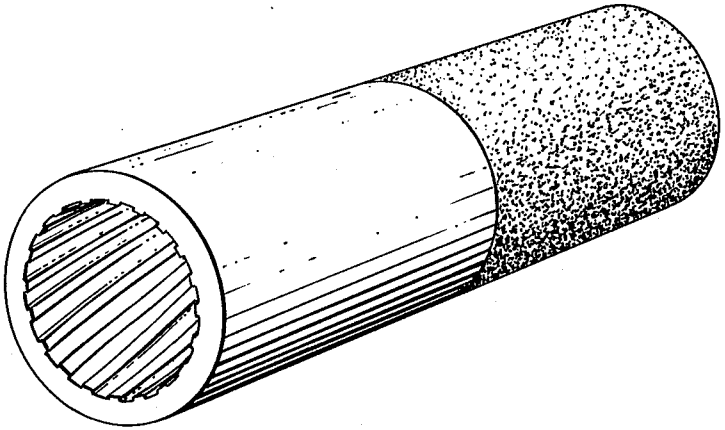
FIG. 1 is a photograph of a section of a barrel illustrating internal rifling.
Figure 2:
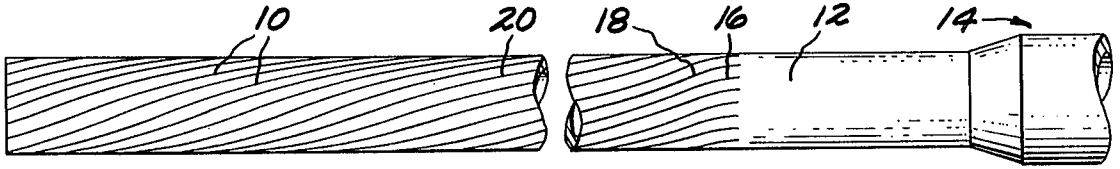
FIG. 2 is a longitudinal elevation of one form of a mandrel for a gun barrel as provided pursuant to this invention.

The mandrel on which a gun barrel may be formed pursuant to the present invention is illustrated in FIG. 2 and may be of a metal such as copper or other high melting point material adapted to be formed with external ribs. The mandrel has external rifling ribs 10 formed on its outer surface 12 so that a barrel liner which is formed on the mandrel will have conforming internal rifling grooves. Such grooves are seen as the light inner shaped layer at the end of the plasma formed gun barrel section of FIG. 1. After formation of the barrel on the mandrel the mandrel is removed as discussed below.

The mandrel may also include a larger end 14 over which the chamber of the barrel is formed. The chamber and the rifled portion are sized so that a subsequent densification by heating will yield barrels with correct final dimensions. One way to achieve such final dimensions is by employing the process described in copending application Ser. No. 546,234 filed Oct. 28, 1983, U.S. Pat. No. 4,537,742; and assigned to the same assignee as the subject application.

Figure 6:
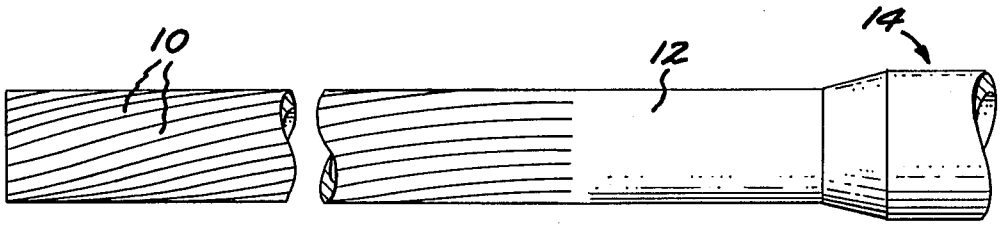
FIG. 6 is a longitudinal elevation of a form of mandrel alternative to that illustrated in FIG. 2.

The rifling ribs are formed on the exterior of the mandrel and such manufacturing process is relatively simple compared with the conventional gun rifling operation. In addition the axial twist of the ribs can be given any desired shapes or curves. One form of rib which is particularly preferred is the rib with the accelerated pitch illustrated in FIGS. 2 and 6. In other words as the projectile first makes contact with the rifling the rifling is aligned with the axis of the bore of the barrel. Then as the projectile moves along the length of the barrel the pitch of the rifling may be changed to give the projectile an increased component of torque and to increase the angular acceleration of the projectile itself.

In FIG. 2 a mandrel is shown having a surface of ribbing adapted to provide one form of rifling which results in accelerated rotation, or gain twist, of a projectile in a gun barrel formed on the mandrel. For this mandrel the first ribbing 16 beyond chamber 14 is axially aligned so that no torque is applied as a projectile contacts complementary axially aligned rifling in a barrel. The pitch of the ribs on the mandrel relative to the barrel axis, and the pitch of the resultant rifling in a barrel formed on the mandrel is increased as illustrated at 18 further down the barrel from the chamber 14. By inducing the gain twist further down the barrel from the chamber the stress due to the twist is separated or spread out from that produced at the chamber. This can benefit the overall operation of the gun in which the barrel is used. After undergoing the initial change in axial twist relative to the axis of the barrel the pitch may be held constant, as at 20, and for the remainder of the length of the barrel.

The present method makes formation of complex rifling patterns in a barrel efficient and economical because the rifling is formed as external lands and grooves on an easy-to-work mandrel rather than in the internal surface of a difficult to work actual gun barrel.

The deposition of a refractory material, such as metal or ceramic or a combination of ceramic and metal, onto the mandrel of FIG. 2 to form an inner liner for a gun barrel is carried through the use of vacuum plasma deposition techniques as taught in U.S. Pat. 3,839,618. The thickness of the liner is carefully designed to minimize the use of more expensive and critical materials. To optimize the use of such expensive liner materials, a plasma gun, which delivers the molten powder is moved relative to the workpiece so that the coating on the mandrel is formed with a significant measure of radial uniformity around the barrel. The deposit is preferably varied in thickness to place higher or greater thickness of the liner material at the portions of the barrel where the greatest wear and greatest heating occur.

Accordingly a thicker layer is formed at the exit of the chamber and also at the start of the rifling. Also a greater thickness is preferably formed at the muzzle of the bore as there is a tendency for a flattening of the rifling lands at this end as the projectile exits from the muzzle end.

Figure 3:
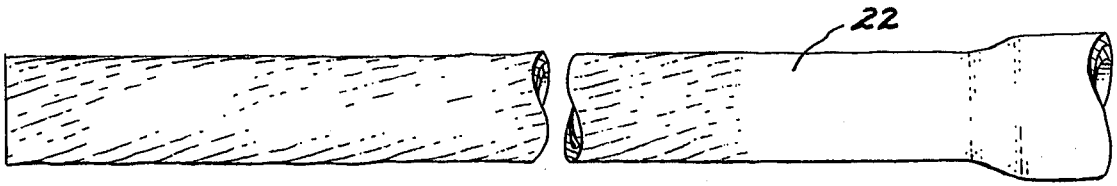
FIG. 3 is a longitudinal elevation of a liner as formed on a mandrel of FIG. 2.

Following the completion of the deposit of the liner material 22 as illustrated in FIG. 3 an intermediate layer may be formed over the liner to provide a transition in properties between the properties of the liner and those of the jacket metal which forms the major bulk of the barrel. The intermediate layer may be formed by mixing the powder used in forming the liner with the powder of the jacket metal.

Figure 4:
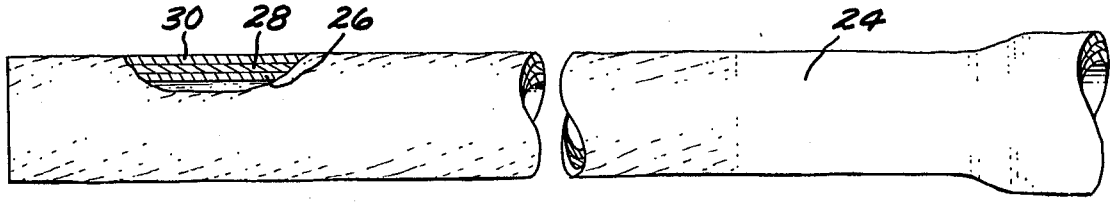
FIG. 4 is a longitudinal elevational view in part in section of a barrel mandrel with an overlaying liner and an overlaying intermediate layer as provided pursuant to this invention.

Also preferably the liner is formed as illustrated in FIG. 3 and the intermediate layer is formed on top of the liner as illustrated in FIG. 4 with no interruption in the forming process. This permits good bonding to be achieved between layers. This also permits the productivity to be maintained at an elevated level. Further it permits maintenance of the barrel temperature at a level preferred for the deposit of the molten metal particles from the plasma and permits a very strong integral bond approaching theoretical strength to be formed between the outer surface of the liner and the intermediate layer.

In FIG. 4 the mandrel with an overlain liner and an intermediate layer overlaying the liner is displayed partly in elevation and partly in section. Intermediate layer 24 reveals less definition of the ribs 10 than layer 22 of FIG. 3, or the ribs themselves 10 of FIG. 2. Three layers 26, 28 and 30 are illustrated in the portion of FIG. 4 illustrated in section. Actually the two outer layers 28 and 30 are less distinct and may appear as a part of the mandrel 26.

Figure 5:
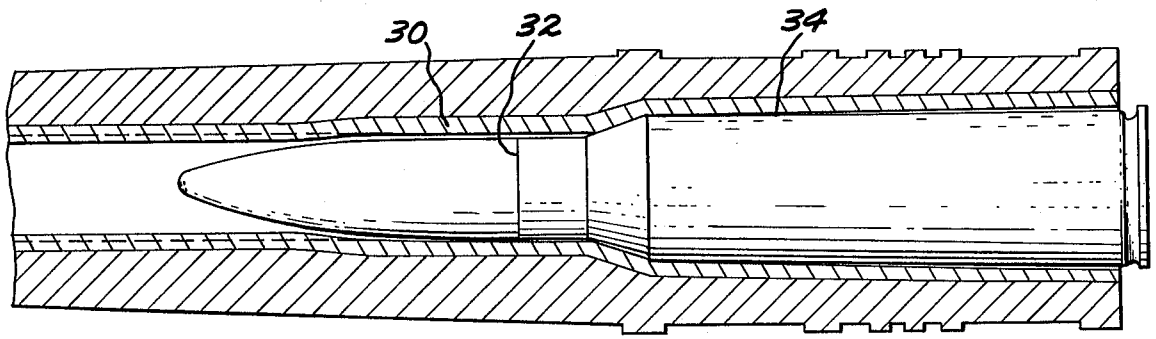
FIG. 5 is a longitudinal sectional view of a gun barrel as formed with a cartridge shown in place in the gun chamber.

In FIG. 5 which is a vertical section along the axis of the bore of the barrel there is illustrated in semi-schematic fashion the composite inner liner plus the intermediate layer, as a single layer, as they fit inside the outer metal jacket as part of the barrel structure of this invention.

Following the formation of the liner and intermediate layer as illustrated in FIG. 4 the outer layer of barrel metal is deposited in successive passes along the barrel to construct the composite barrel as semi-schematically illustrated in FIG. 5. The drawing of FIGS. 4 and 5 is referred to as semi-schematic because the dimensions of the composite liner and intermediate layer are shown out of proportion in order to make clear the composite nature of the combined liner and intermediate layer and also to illustrate by the drawing what can't be seen clearly in the article as formed as for example in the article of FIG. 1.

The finished barrel article is illustrated in vertical section in FIG. 5 and provides a novel gun barrel which has a number of advantages as follows.

First it is effective in maintaining to a minimum the friction in the chamber so that the rounds and cartridges can be introduced and withdrawn to and from the chamber rapidly.

Secondly the refractory metal liner prevents the melting of the bore surface in the breech end and elsewhere along the barrel. This location 30 is where the highest temperature is developed as the propellant burns in the cartridge and is expelled from the cartridge opening 32 into the breech end 30 of the barrel. The enlarged breech 34 is not excessively heated but is subjected to high forces requiring a high modulus of elasticity as the propellant in the cartridge expands.

Because of the good metallurgical bond between the liner and the intermediate layer and of the intermediate layer with the jacket of barrel metal, a very high level of heat transfer is achieved through this layer and from the layer to minimize the accumulation of heat at the bore surface. However, because the bore surface is a refractory material, including a metal such as tantalum, tungsten, molybdenum, or the like, metal or ceramics such as carbides, oxides or similar compounds of refractory or other metals, such refractory surface can withstand heating and thermal shock at very elevated temperatures without incipient melting. Because the metal of the liner is at the higher temperatures which can be tolerated by refractory materials there is a much higher thermal driving force driving the heat from the liner surface through the barrel metal to the barrel exterior. The outer barrel surface can be at a higher temperature, and accordingly release more heat to its environment, than conventional barrels without causing damages, such as are described above, to the interior surfaces of the barrel. Consequently the composite gun barrel can sustain higher flame temperatures and meet the requirements of a structural integrity of a high performance gun barrel.

Further the construction of this composite barrel prevents the wear of the barrel further down particularly as the metal of the rifling starts to apply force and rotary motion to the projectile as it advances through the bore. This composite construction has the effect of lessening the wear. Further because of the very effective control of the rifling in the bore and at the muzzle and the ability to tailor the rifling so that it undergoes a change in pitch along the length, the development of high wear at portion of the bore where the rifling starts is reduced. Also the incorporation of the refractory metals into the composite structure improves the barrel inasmuch as they retain their physical properties at higher temperatures and this resistance to high temperature wear further influences a reduction in the wear at this portion of the bore.

A further advantage is in lessening and preventing the flattening of the rifling particularly in the area proximate the chamber and muzzle. Special tailoring of the pitch of the rifling proximate the bore as in forming the mandrel of FIG. 1 or FIG. 2 is similarly feasible. As noted above there is a greater tendency for the rifling to wear at the chamber end of the barrel and the muzzle. The use of the liner of this invention with the refractory metal and with the extremely good metallurgical bond both between the refractory metal and the intermediate layer, and between the intermediate layer and the solid metal jacket, provides a greater resistance on the part of these components to wear. A key advantage of this invention is to provide a combination of a highly wear resistant material bonded through an intermediate layer to a high strength metal jacket to yield a near net product.

The materials which are used for fabrication of the liner of the present invention are high melting temperature materials and these can include the following: tantalum alloys, such as, Ta-10W (Ta-10 w/o W) or T-111

(Ta-8W-2Hf); columbium base alloys (C-129Y); chromium, tungsten base, molybdenum base alloys (TZM); and the platinum group alloys. The materials also include the non-metal refractory materials such as carbides, oxides, borides as well as cermets and combinations of metals and non-metal refractories.

In addition to the use of conventional methods of hardening the refractory metals by various thermomechanical alloying and related techniques, the present method permits the addition of compounds such as carbides, oxides and borides which can be included in the powder from which the various layers of the product of the present invention can be formed. Alternately, the very inner surface of the liner may be entirely oxide, carbide or boride, grading to a refractory metal.

The mandrel onto which the refractory liner is plasma deposited can be smooth for those barrels which fire fin stabilized projectiles.

A smooth bore barrel can be formed for later machining to form internal rifling. However some of the advantages of the present invention are lost if the thin layer of the refractory metal is first formed on the interior of the barrel and this surface is then machined at a later date after the mandrel has been removed.

Conventional machining involves broaching, rotary forging or electrochemical machining and would destroy the protective inner refractory liner.

However, these steps are eliminated where the mandrel itself bears the form of the rifling to be imparted to the bore so that the bore doesn't have to be machined at a later time. The gun barrels of this invention are made without internal machining although the external surface may be machined to final dimensions.

The interface layer between the liner and the jacket is preferably made to have a gradual transition in properties between those of the refractory material of the liner and those of the metal of the jacket and to ensure a sound metallurgical bond between the layers. The gradual transition in properties can be important in making the backup properties of the outer jacket available to the liner of the barrel inasmuch as the disruptive forces caused by propellant burning and projectile movement are delivered to the barrel at the liner.

The external jacket of the gun barrel which provides the needed strength and rigidity for the barrel is also vacuum plasma formed. The jacket can be sprayed to near net shape and to include metal for various clamps and mounting mechanism by controlling the number of plasma spray passes. This control can be exercised by developing a program for the relative movement of the plasma gun and the mandrel as the barrel layers are formed and deposited on the mandrel. The jacket itself can be plasma sprayed from conventional small arms steel alloys containing chromium, molybdenum and vanadium or from large caliber barrel type steels such as the AISI 4340 steels.

A black corrosion protection coating can be applied over the jacket for barrels which do not require external machining as for example where there are clamping surfaces which must be formed with close tolerances. The black surface assists in heat radiation to improve barrel cooling and also to provide limited corrosion protection.

Where the metal is formed with voids due to the vacuum plasma spraying the voids can be reduced or eliminated by secondary treatments of the barrel. One such treatment involves heating the barrel to an elevated temperature for a time which consolidates the metal of the barrel. Alternatively hot gas isostatic pressing may be employed. Further for some barrels hot forging may be used to consolidate the barrel following its spray formation.

After the barrel has been consolidated the mandrel is mechanically removed or dissolved chemically to leave a finished inner refractory surface to be used as the inner surface of the barrel liner.

A heat treatment to provide desirable mechanical properties may be applied to the liner and to the jacket following the removal of the mandrel. Such heat treatment can impart improvements to the combined barrel structure and enhance its properties.

Finish machining may be required for certain barrels particularly to facilitate the mounting of the barrel into some other mechanical mechanism.

The metal of the transition layer is a composition of refractory metal of the refractory layer and the jacket metal of the jacket layer. It may have a lower proportion of the more expensive refractory metal and the proportion of the refractory and jacket metal may vary through the thickness of the transition layer. Ratios of 90% refractory metal and 10% jacket metal to 10% refractory metal and 90% jacket metal are useful. A concentration gradient may be, and preferably is formed in the intermediate layer extending from the liner to the jacket.

The thickness of the refractory metal liner may be smaller where higher ratios of refractory metal are employed in the intermediate layer.

One advantage of the present invention is that the composite structure is formed with the three intimately bonded layers and all three layers may be formed using only two distinct powders to be fed to the plasma gun. One powder is the refractory metal powder and the other is the jacket metal powder. Further the barrel may be formed in one continuous plasma spray session starting with the refractory metal, to deposit the liner over the length of the mandrel, then by switching to a powder mix of refractory and jacket metal powders to form the intermediate layer, and by then switching to a powder entirely made up of jacket metal.

A higher thickness of liner metal may be deposited around the chamber end of the mandrel or around the portion of the mandrel where the greater stress is to be developed based on the design of the barrel and the use to be made of it.

A greater liner thickness may be formed at the section of the barrel where the projectile first meets the rifling if the rifling design is one which develops great stress in this section.

Abrasion and wear down of rifling at the muzzle can be lessened by increasing the liner thickness at this section of the barrel.

Where close tolerances of the internal dimensions of the barrel are desired they may be achieved with the aid of the process taught in copending application Ser. No. 546,234 filed Oct. 28, 1983, U.S. Pat. No. 4,537,742, and assigned to the same assignee as the subject application. The text of this copending application is incorporated herein by reference but is not essential to the practice of the present invention.

Suitably the inner liner may have a thickness of between ten and twenty mils, the intermediate layer may have a thickness of ten to twenty mils and the jacket may have a thickness ranging from about three-eighth to about three-quarters of an inch.

We claim:

1. A composite gun barrel comprising, an inner liner of a refractory metal, a transition layer of said refractory metal and a jacket metal, said transition layer being bonded to said liner, an outer jacket of structural metal bonded to said transition layer, said liner, transition layer and jacket being intimately metallurgically bonded together.

2. The barrel of claim 1 wherein the transition layer is graded in composition from a high concentration of refractory at the inner portion of the transition layer to a low concentration of refractory at the outer portion of the transition layer.

3. The barrel of claim 1 wherein the inner liner refractory metal has an inner rifled surface and a greater thickness of refractory is disposed at the rifled muzzle end of the barrel than along the remainder of the rifling of the barrel.

4. The barrel of claim 1 wherein the barrel includes a chamber at one end and the inner liner refractory metal has an inner rifled surface and a greater thickness of refractory is disposed in the rifling proximate the chamber.

5. The barrel of claim 1 wherein the inner inner refractory metal has a variable pitch inner rifled surface and wherein a greater thickness of refractory is disposed at the location of the rifling where the rifling is given an increased pitch.

6. The barrel of claim 1 wherein the barrel includes a chamber at one end to receive a cartridge and a greater thickness of refractory is disposed where the gases exit the cartridge.

7. The barrel of claim 1 wherein the barrel includes a chamber at one end thereof and a greater thickness of liner is formed about the chamber of the barrel.

* * * * *